US006182987B1

(12) United States Patent
Bryant

(10) Patent No.: US 6,182,987 B1
(45) Date of Patent: Feb. 6, 2001

(54) TRUCK ASSEMBLY WITH REPLACABLE AXLES AND BALL JOINT PIVOTS

(76) Inventor: Dwayne Lester Bryant, 11132 Pine Ave., Lynwood, CA (US) 90262

( * ) Notice: Under 35 U.S.C. 154(b), the term of this patent shall be extended for 0 days.

(21) Appl. No.: 09/392,755

(22) Filed: Sep. 8, 1999

(51) Int. Cl.[7] ..... A63C 17/92
(52) U.S. Cl. ..... 280/87.042; 280/11.28
(58) Field of Search ..... 280/11.28, 11.19, 280/87.041, 11.27, 87.042, 809; 301/137, 5.7

(56) References Cited

U.S. PATENT DOCUMENTS

| | | | | |
|---|---|---|---|---|
| 2,653,821 | * | 9/1953 | Ware | 280/11.28 |
| 4,159,830 | * | 7/1979 | Solimine | 280/11.28 |
| 4,305,598 | * | 12/1981 | Brandner | 280/11.28 |
| 4,311,319 | * | 1/1982 | Snyder et al. | 280/11.28 |
| 5,372,384 | * | 12/1994 | Smith | 280/11.28 |
| 5,478,095 | * | 12/1995 | Marandel | 280/11.28 |

* cited by examiner

*Primary Examiner*—Richard M. Camby
(74) *Attorney, Agent, or Firm*—Beehler & Pavitt; William H. Pavitt, Jr.; David A. Belasco

(57) ABSTRACT

An improved skate or skateboard truck is disclosed which incorporates precision steering and rocking components for consistency and accuracy during maneuvers and a method for removing or replacing worn or broken axles. A yoke containing the truck's axle includes a central body portion into which a precision ball socket has been machined. It is jointed by a spherical component for the yoke to pivot around. It is also fitted with a precision ball pivot pin opposite the socket which will act as the associate pivotal and rocking mechanism for the truck assembly. The base is comprised of a central body into which a stud is secured for mounting the yoke and a pocket has been machined for containing a precision ball socket to accept the associate ball pivot pin. A sloted configuration situated at each end of the yoke can be compressed with screws to allow the axle to be removed or replaced.

3 Claims, 2 Drawing Sheets

TRUCK ASSEMBLY WITH REPLACABLE AXLES AND BALL JOINT PIVOTS

This invention pertains to assemblies for mounting pairs of wheels to the underside of a skateboard or roller skates. More specifically, it pertains to a novel skateboard steering and rocking mechanism known as a truck.

BACKGROUND OF THE INVENTION

Trucks are well known devices having numerous references in the art. Conventional skateboards and roller skates are equipped with steering mechanisms known as trucks. The main body of the truck is generally formed by placing the axle, onto which the wheels will be rotatably attached, into the mold when the truck is cast so as to bond the two metals into one piece. Thus once the axle becomes damaged in any way; this necessitates the replacement of the entire truck.

Additionally, conventional trucks follow a basic design in which an axle pivots about an arm attached at one end to the center portion of the axle. The other end of this pivot arm is loosely fitted, at an angle of approximately 45 degrees, into a plastic cup mounted in a baseplate, thus forming a ball-like joint. A pair of doughnut-shaped grommets, usually made of rubber or urethane plastic of various hardnesses, is mounted on a substantially vertical kingpin fixed in the baseplate on the side of the axle opposite the plastic cup. These grommets grasp a ring extending from the axle body so that the axle is suspended between the ball-like joint and the grommets. By adjusting the kingpin, the tension on the grommets may be increased or decreased, thereby varying the balance between turning stability and turning ease. The kingpin employed in conventional trucks is oriented at a substantially right angle to the tilting movement of the deck, resulting in high stress on the kingpin. Because the kingpin and the grommets do not adequately stabilize the pivot arm axis, and because of the loose fit between the pivot arm and the plastic cup, the angle of the pivot axis tends to deteriorate as the axle tilts, so that very tight turns may be difficult or impossible to achieve.

A further drawback of this standard design is that the suspension system formed by the plastic grommets fails to provide fine steering control. Riders control the angle of the deck's tilt, and thus the size of the turns they make, by varying the distance by which they shift their weight laterally across the width of the deck. Regardless of their hardness or of how they are adjusted, the standard urethane grommets do not offer a regular, orderly pattern of resistance to such weight shifts. The result is that the riders cannot easily predict or measure how far they must shift their weight to achieve steering radii of various sizes.

Moreover, when a rider removes his weight from the side of the deck at the end of a turn, the plastic grommets used in conventional trucks do not return the vehicle to the neutral, non-turning position quickly enough. Sideward shifts of a rider's body mass create forces, which compress the grommets, thus causing the deck to tilt arid the vehicle to steer. Conventional trucks behave like dampers in the sense that the energy used to compress the grommets is largely dissipated; the grommets retain very little of this energy for use in quickly rebounding the axles to the straight-ahead position. This is especially noticeable, and troublesome, when the rider attempts to propel and accelerate himself by means of quick, alternating turns. High-performance riding depends upon the ability of the trucks to quickly resume straight-forward motion after the rider discontinues a lateral weight shift.

Additionally, conventional trucks often begin to feel kinked, as if they "want" to steer in one direction more than the other, such as to the left more than to the right. The plastic cup in which the axle pivot arm swivels, and the urethane grommets, tend to permanently deform in an asymmetrical manner in accordance with the rider's steering habits and may oppose his attempts to steer the vehicle either straight ahead or against the memory of the plastic cup and grommets.

Various prior patent arts have used springs or alternate axle configurations to allow for adequate steering control. Progression to the use of the current standard with the plastic cup and grommets was a logical step, but still does not have the consistency or precision necessary for high performance acrobatic maneuvers.

SUMMARY AND OBJECTS OF THE INVENTION

In the present invention a pair of the novel trucks is fastened to the underside of the deck of a rideable vehicle such as a skateboard. Each truck is formed of three separate components, the baseplate, the main body, and the axle. The baseplate is formed such that it is attachable to the underside of the deck of a skateboard by some means. A stud is threaded into the baseplate nearly perpendicular to the deck of the vehicle. A socket is formed in the opposite end to house the pivot pin at an approximately 45-degree angle. The main body is arranged to form a yoke that supports the means for attaching it to both the baseplate and the axle. The yoke attaches to the baseplate in the forward portion by means of a tongue extending from the yoke through which a hole is formed to allow connection to the stud protruding from the baseplate. This hole is formed in the shape of a half sphere and the yoke is held in place by a half spherical grommet, which is in turn held in place by a nut attached to the end of the stud. Opposite this tongue, a pivot pin, the end of which is formed into a spherical shape, is attached by some means. The spherical end is inserted into the socket formed in the baseplate with an additional ball socket formed of a shock absorbent material. An opening is formed perpendicular to these means of attachment to house the axle. Once the axle is in place, it is restrained by some means such as screws or bolts that can be tightened to decrease the diameter of the opening in the yoke. The axle is created in the shape of a rod or dowel with some means on each end whereby wheels may be attached.

In view of the above-described art, the present invention seeks to realize, among other things, the following objects and advantages.

A principal object of the present invention is to provide the option of replacing the axle as opposed to replacing the entire truck when the axle becomes damaged.

Another principal object of the present invention is to provide a more durable steering mechanism, wherein the cup and grommets will not wear in an asymmetrical manner.

Another major object of the present invention is to provide a new and improved steering mechanism for a skateboard or similar vehicle for achieving sharper turns and a consistent and predictable steering response.

These and other objects and advantages of the invention will become more fully apparent from the description and claims which follow, or may be learned by the practice of the invention.

BRIEF DESCRIPTION OF DRAWINGS

For a more complete understanding of this invention, reference should be made to the accompanying drawings in which.

DETAILED DESCRIPTION OF THE PREFERRED EMBODIMENT

Figure 1:
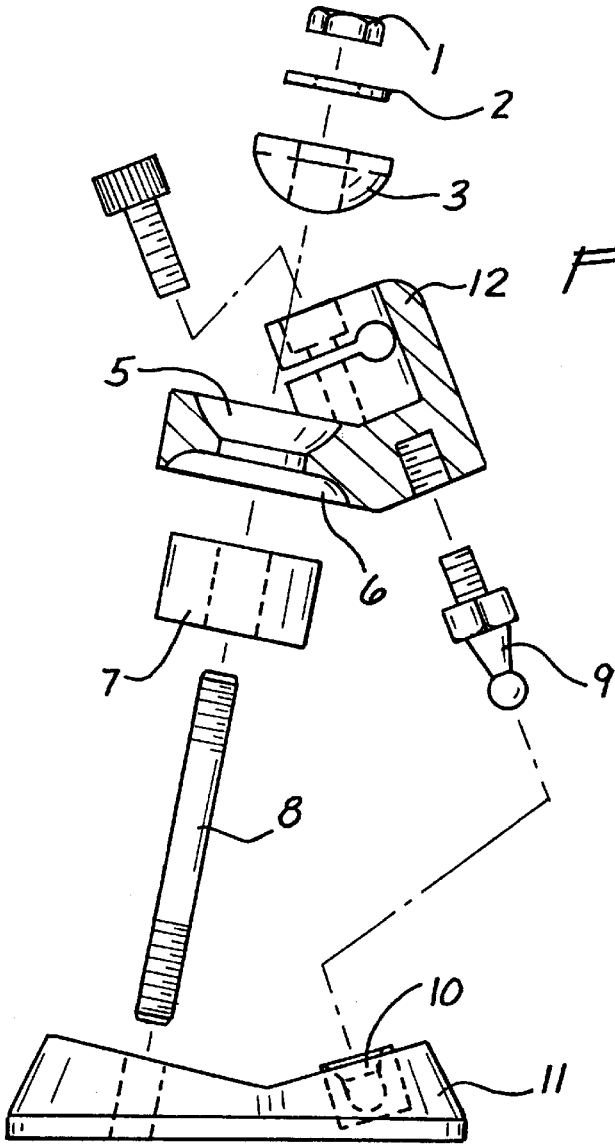
FIG. 1 is an exploded inverted side view partially cut away.
Figure 1A:
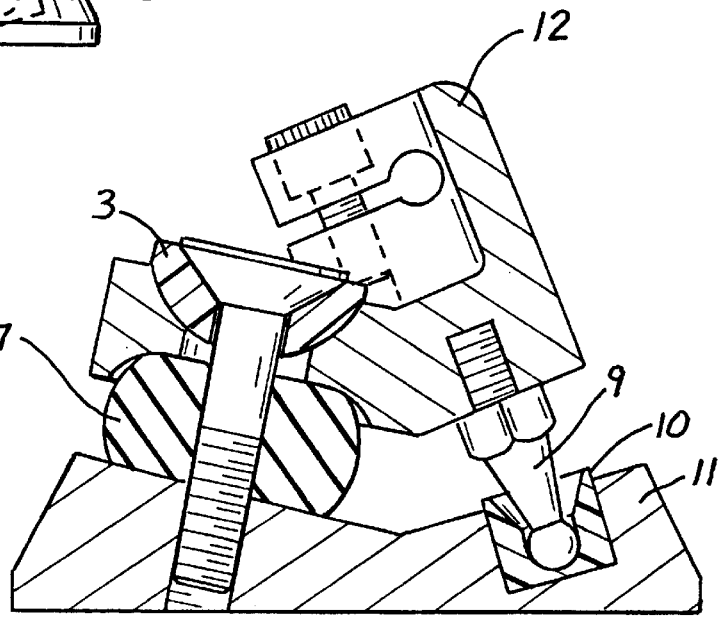

In the drawings, one preferred embodiment of the invention is shown. While the preferred embodiment described is intended for use with skateboards, it should be understood that the invention, including its various elements, will also be applicable to other rolling platform vehicles which are powered by the rider, or by gravity, or by some combination thereof.

In FIG. 1 the baseplate 11 has means for securing it to the underside of the deck of a rideable vehicle. The truck yoke 12 is attached to the baseplate 11 at two extremities perpendicular to the aperture for the axle below. A threaded stud 8 is secured in the baseplate 11 and extending in a nearly perpendicular fashion from it. Next a cylindrical grommet 7 of some shock absorbent material such as rubber goes over the stud 8. A cylindrical recess 6 is formed in the yoke 12 at one extremity to receive the grommet 7 to allow for a secure fit. Next the yoke 12 is mounted on the stud 8. The yoke also has a recess 5 formed in a half sphere to allow smooth contact with a half spherical grommet 3, which is mounted next over the stud 8. A washer 2 and a lock nut 1 follow this. At the opposite end of the baseplate 11, a socket is formed to allow placement of a steering ball socket 10 of some shock absorbent material. A steering ball pivot pin 9, which has been attached to the yoke 12 at another extremity by some means, is fit into the steering ball socket 10. This combination of ball joints allows for greater steering control.

Figure 2:
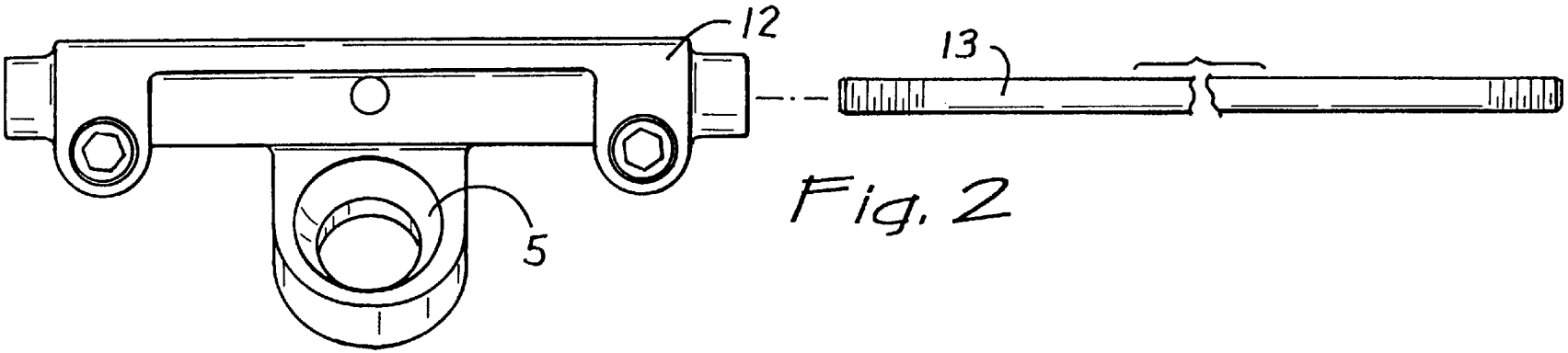
FIG. 2 is an exploded bottom view.

The yoke 12 has an aperture through the body portion, extending outwardly through the end portions to allow for placement of the axle 13, with means on the ends for securing wheels. The yoke 12 also has a slot in each end extending to the aperture which allow the axle 13 to be held in place by two screws 4 as seen in FIG. 2.

Those skilled in the art will readily see that while numerous detailed variations of the above-described embodiment of this invention may be made, the true scope of the invention is to be determined by the following claims.

I claim:

1. A skateboard truck, comprising:

an axle, said axle having a first end, a second, and a first predetermined length;

each of said first and second ends including means for removably securing a wheel;

a yoke, said yoke including an axle retaining portion, a pivot pin attachment portion, and a shock absorber retaining portion;

said axle retaining portion having a center point, first and second end portions, each of said end portions extending outwardly from said center point in opposite directions;

an aperture, said aperture being sized, shaped and disposed to fit frictionally said axle and extending through said first and second end portions;

first and second slits, each of said slits penetrating one of said first and second end portions and extending into said aperture parallel to a long axis of said aperture, said slits dividing each end portion into an upper part and a lower part;

means for compressing said first and second slits so as urge said upper parts toward said lower parts to secure said axle within said aperture;

said pivot pin attachment portion having a first surface and a second surface and extending upwardly from said axle retaining portion perpendicular to the long axis of said aperture and providing a mounting point for a steering ball pivot pin above said center point;

a steering ball pivot pin secured to said mounting point;

a shock absorber retaining portion; said retaining portion extending outwardly from said second surface of said pivot pin attachment portion;

said shock absorber retaining portion having an upper surface, a lower surface and a cylindrical opening penetrating said upper and lower surfaces;

said cylindrical opening being perpendicular to said long axis of said aperture and coplanar with said center point;

said upper surface including a cylindrical recess collinear with said cylindrical opening;

said cylindrical recess being sized shaped and disposed to accommodate a cylindrical grommet;

a cylindrical grommet formed of shock-absorbing material and having a central mounting hole;

said lower surface including a semi-spherical recess collinear with said cylindrical opening;

said semi-spherical recess being sized shaped and disposed to accommodate a semi-spherical grommet;

a semi-spherical grommet formed of shock-absorbing material and having a central mounting hole;

a baseplate, said baseplate having an upper surface, a lower surface, and means for securing said upper surface to an underside of a deck of a rideable vehicle;

said lower surface including a threaded aperture and means for receiving a ball socket;

a ball socket formed of shock-absorbent material, said ball socket being secured to said lower surface of said baseplate;

said threaded aperture disposed to align with said cylindrical opening and said ball socket disposed to align with said steering ball; and means for securing said yoke to said threaded aperture of said baseplate.

2. A skateboard truck as described in claim 1, wherein the means for compressing the first and second slits so as urge said upper parts toward said lower parts to secure the axle within the aperture further comprises:

first and second machine screws, each of said machine screws having a head and a threaded shank;

first and second clear holes extending through the lower parts of said first and second end portions, said clear holes being sized, to allow said threaded shank to pass there though;

first and second threaded holes extending into the upper part of said first and second end portions, each of said threaded holes being sized and threaded to removably engage said machine screws; and said machine screws being passed through said clear holes and threaded into said threaded holes until said machine screw heads bearing against said lower parts urge said lower parts toward said upper parts to secure the axle within the aperture.

3. A skateboard truck as described in claim 1, wherein the means for securing the yoke to the threaded aperture of the baseplate further comprises:

a threaded stud, said stud being sized, shaped and threaded to removably engage said threaded aperture in said base plate;

a washer, said washer being sized to cover at least a portion of the semi-spherical grommet and to fit slidably over said threaded stud;

a nut, said nut being sized and threaded to removably engage said threaded stud; and said threaded stud being removably threaded into said threaded aperture of said baseplate, said cylindrical grommet being placed over said stud, said cylindrical opening of said shock absorber retaining portion being placed over said stud, said semi-spherical grommet being placed over said stud, said washer being placed over said stud, said nut being threaded onto said stud and tightened to compress said grommets.

* * * * *